US005662501A

United States Patent [19]

Yagi et al.

[11] Patent Number: 5,662,501

[45] Date of Patent: Sep. 2, 1997

[54] DOUBLE-RETAINING CONNECTOR

[75] Inventors: Sakai Yagi; Masanori Tsuji; Keishi Jinno, all of Shizuoka, Japan

[73] Assignee: Yazaki Corporation, Tokyo, Japan

[21] Appl. No.: 632,138

[22] Filed: Apr. 15, 1996

Related U.S. Application Data

[62] Division of Ser. No. 385,304, Feb. 7, 1995.

[30] Foreign Application Priority Data

Feb. 10, 1994 [JP] Japan ..... 6-016628

[51] Int. Cl.[6] ..... H01R 13/436

[52] U.S. Cl. ..... 439/752

[58] Field of Search ..... 439/752, 595

[56] References Cited

U.S. PATENT DOCUMENTS 5,224,883 7/1993 Yamamoto ..... 439/752

5,299,958 4/1994 Ohsumi ..... 439/752

*Primary Examiner*—Gary F. Paumen

*Attorney, Agent, or Firm*—Sughrue, Mion, Zinn, Macpeak & Seas

[57] ABSTRACT

To provide a double-retaining connector in which terminals can be inserted smoothly, thereby enhancing an operation efficiency and eliminating an obstacle to the achievement of an automation production. In the double-retaining connector, a cavity is formed in a connector housing, and a spacer is provided so as to be inserted into the cavity in a two-stage manner, that is, in a provisionally-retained condition and a completely-retained condition, and the spacer has openings which are aligned respectively with terminal receiving chambers in the provisionally-retained condition of the spacer so as to allow terminals to pass through the openings, respectively. Each of the terminal receiving chambers is divided by the cavity into a front receiving chamber and a rear receiving chamber in such a manner that the cavity is interposed between the front and rear receiving chambers. At a boundary between the opening and the rear receiving chamber, an open end of the opening is larger than an open end of the rear receiving chamber. At a boundary between the front receiving chamber and the opening, an open end of the front receiving chamber is larger than an open end of the opening.

7 Claims, 5 Drawing Sheets

DOUBLE-RETAINING CONNECTOR

This is a divisional of application Ser. No. 08/385,304 filed Feb. 7, 1995.

BACKGROUND OF THE INVENTION

1. Field of The Invention

This invention relates to a double-retaining connector in which each terminal is retained in a double manner not only by an elastic retaining arm, provided within a terminal receiving chamber, but also by a spacer inserted across the terminal receiving chamber.

2. Related Art

Usually, an elastic retaining arm (hereinafter referred to as "lance") for preventing withdrawal of a terminal is provided within each terminal receiving chamber of a connector. However, the dimensions of the lance are limited, for example, because of a compact design of the connector, and therefore the lance often fails to provide a sufficient force to retain the terminal. In such a case, a terminal retainer separate from the lance is additionally used to retain the terminal in a double manner, thereby enhancing the retaining effect.

A double-retaining connector of this type disclosed in Japanese Patent Unexamined Publication No. 5-144499, in which a terminal retainer is inserted into terminal receiving chambers to retain terminals in a double manner, will now be described with reference to FIG. 4. FIG. 4 is an exploded perspective view of the conventional double-retaining connector provided with the spacer.

Two (upper and lower) rows of juxtaposed terminal receiving chambers 3 are formed in a connector housing 1, and each terminal receiving chamber 3 is provided with a lance (not shown) for primarily retaining a terminal 5. A cavity 7 is formed at a central portion of the connector housing 1 across the terminal receiving chambers 3, and the cavity 7 is open to an upper surface la of the connector housing 1. A terminal retainer (hereinafter referred to as "spacer") 11 is inserted into the cavity 7, and the spacer 11 is of a grid configuration having a plurality of juxtaposed openings 9. The spacer 11 is inserted into the cavity 7 in a two-stage manner, that is, in a provisionally-retained condition and a completely-retained condition, and in the provisionally-retained condition, each terminal 5 can pass through the associated opening 9, and then the spacer is further inserted to be brought into the completely-retained condition after the terminals 5 are thus inserted. The opening portion 9 has a terminal retaining portion 13 projected toward the center of the opening 9, and the terminal retaining portion 13 is engaged in a retaining hole 15 formed in the terminal 5.

In the double-retaining connector of this construction, for retaining the terminals 5 in a double manner, the terminals 5 are first inserted into the respective terminal receiving chamber 3 in the provisionally-retained condition of the spacer 11. As a result, each terminal 5 is primarily retained by the lance. Then, the spacer 11 is further inserted into the completely-retained condition, so that the terminal retaining portions 13 are engaged respectively in the retaining holes 15 in the terminals 5.

Thus, each terminal 5 is retained in a double manner at the two portions by the lance and the terminal retaining portion 13, thereby achieving a sufficient terminal-retaining force.

In the conventional double-retaining connector, the spacer 11 for effecting the double-retaining can be inserted into the cavity 7, and in the provisionally-retained condition, the openings 9 are aligned with the terminal receiving chambers 3, respectively, so that the terminals 5 can pass through the openings 9, respectively.

With this construction, however, in the provisionally-retained condition, the openings 9 are required to be exactly aligned with the terminal receiving chambers 3, respectively. If the openings 9 are not exactly aligned respectively with the terminal receiving chambers 3, for example, because of dimensional irregularities of the terminal receiving chambers 3 and the openings 9 and a play between the connector housing 1 and the spacer 11, steps 17*a* and 17*b* develop at regions A and B in FIG. 5, and the front end of the terminal 5 inserted in an inclined posture abuts against the step 17*a*, 17*b* (See FIG. 6), which results in a problem that the insertion of the terminal 5 is adversely affected. Therefore, when the terminals 5 are to be inserted, for example, by an automation machine, an inserting resistance is increased for this reason, which results in a problem that an abnormal operation of the automation machine occurs.

The terminal 5, when found defective or degraded, need to be exchanged, and at this time during the withdrawal of the terminal, the terminal 5 is liable to be engaged by steps 19*a* and 19*b* formed at regions C and D (FIG. 7), thus causing a problem that the efficiency of the operation is low.

SUMMARY OF THE INVENTION

The present invention has been made in view of the above problems, and an object of the invention is to provide a double-retaining connector in which terminals can be inserted smoothly, and can be inserted by an automation machine, thereby enhancing the operation efficiency and eliminating an obstacle to the achievement of an automation production.

The above object has been achieved by a double-retaining connector wherein terminal receiving chambers are formed within a connector housing; a cavity is formed in the connector housing across the terminal receiving chambers, and is open to an outer surface of the connector housing; a spacer is provided so as to be inserted into the cavity in a two-stage manner, that is, in a provisionally-retained condition and a completely-retained condition; and the spacer has openings which are aligned respectively with the terminal receiving chambers in the provisionally-retained condition of the spacer so as to allow terminals to pass through the openings, respectively; characterized in that each of the terminal receiving chambers is divided by the cavity into a front receiving chamber at a front side in a terminal inserting direction and a rear receiving chamber at a rear side in such a manner that the cavity is interposed between the front and rear receiving chambers; at a boundary between the opening and the rear receiving chamber, an open end of the opening is larger than an open end of the rear receiving chamber; and at a boundary between the front receiving chamber and the opening, an open end of the front receiving chamber is larger than an open end of the opening.

The double-retaining connector may be of a construction in which flat tapering surfaces are formed respectively at edges of terminal insertion-side open ends of the opening and the front receiving chamber, and are slanting in an inserting direction so that the terminal will not be caught by the edges.

The double-retaining connector may be of a construction in which flat tapering surfaces are formed respectively at edges of terminal withdrawal-side open ends of the opening and the rear receiving chamber, and are slanting in a withdrawing direction so that the terminal will not be caught by the edges.

The double-retaining connector may be of a construction in which the tapering surfaces formed at the open end edges are convexly curved.

In the double-retaining connector in which the open end of the opening is larger than the open end of the rear receiving chamber, and the open end of the front receiving chamber is larger than the open end of the opening, the edge of the open end of the opening is disposed outwardly of the open end of the rear receiving chamber in the provisionally-retained condition of the spacer, and also the edge of the open end of the front receiving chamber is disposed outwardly of the open end of the opening. Therefore, any step against which the terminal abuts during the insertion thereof is not formed at the boundary between the terminal receiving chamber and the spacer.

In the double-retaining connector in which the tapering surfaces are formed respectively at the terminal insertion-side ends of the front receiving Chamber and the opening, and the tapering surfaces are formed respectively at the terminal withdrawal-side ends of the opening and the rear receiving chamber, peripheral grooves of a V-shaped cross-section are formed in the inner periphery respectively at the boundary between the opening and the rear receiving chamber and the boundary between the front receiving chamber and the opening. In this condition, any projected step for catching the terminal is not formed, or even if a step is formed, it will not serve to catch the terminal.

If the tapering surfaces are convexly curved, the friction between the terminal and the tapering surface produced when they contact each other is reduced, so that the terminal is less liable to be caught during the insertion and withdrawal thereof.

DESCRIPTION OF THE PREFERRED EMBODIMENTS

A preferred embodiment of a double-retaining connector of the present invention will now be described in detail with reference to the drawings.

Figure 1:
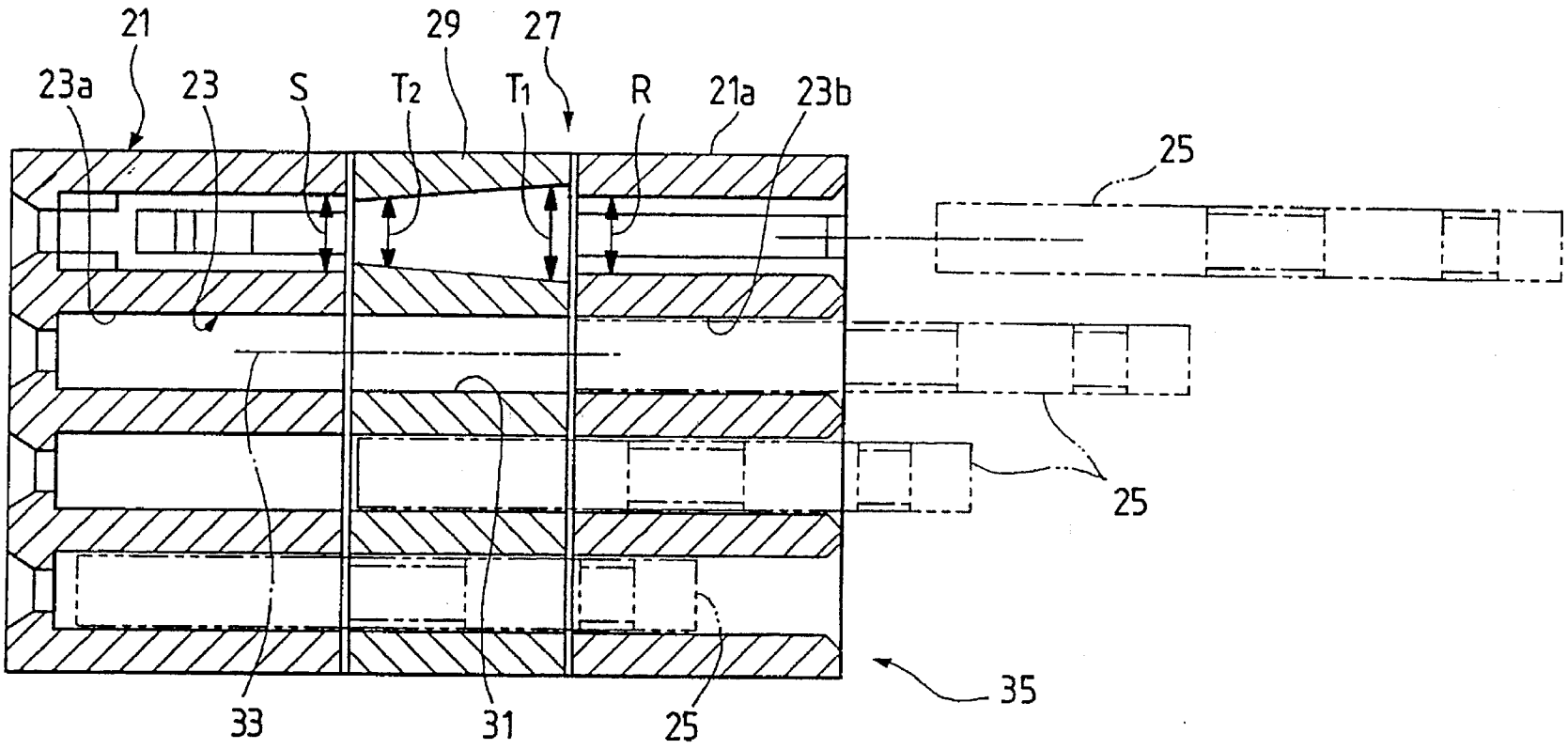
FIG. 1 is a transverse cross-sectional view of a double-retaining connector of the present invention in a direction of juxtaposition of terminal receiving chambers.

FIG. 1 is a horizontal cross-sectional view of the double-retaining connector in a direction of juxtaposition of terminal receiving chambers.

A plurality of juxtaposed terminal receiving chambers 23 are formed in upper and lower rows in a connector housing 21, and a lance (not shown) for primarily retaining a terminal 25 is provided within each terminal receiving chamber 23. A cavity 27 is formed at a generally central portion of the connector housing 21 across the terminal receiving chambers 23, and the cavity 27 is open to an upper surface 21*a* of the connector housing 21. A spacer 29 is inserted into the cavity 27, and the spacer 29 is of a grid configuration having a plurality of juxtaposed openings 31. The spacer 29 is inserted into the cavity 27 in a two-stage manner, that is, in a provisionally-retained condition and a completely-retained condition, and in the provisionally-retained condition, each terminal 25 can pass through the associated opening 31, and then the spacer is further inserted to be brought into the completely-retained condition after the terminals 25 are thus inserted. The opening portion 31 has a terminal retaining portion 13' (see FIG. 2) projected toward the center of the opening 31, and the terminal retaining portion 13' is engaged in a retaining hole 15 formed in the terminal 25.

The terminal receiving chamber 23 is divided by the cavity 27, provided at the central portion, into a front receiving chamber 23*a* at a front side in the terminal inserting direction and a rear receiving chamber 23*b* at a rear side in such a manner that the cavity 27 is interposed between the front and rear receiving chambers 23*a* and 23*b*. When the spacer 29 inserted into the cavity 27 is disposed in the provisionally-retained condition, the front receiving chamber 23*a*, the associated opening 31 and the rear receiving chamber 23*b* are disposed on a common center axis 33.

The terminal receiving chamber 23 and the opening 31 are formed in accordance with a predetermined dimensional relation. More specifically, a transverse inner dimension $T_1$ of the opening 31 is larger than a transverse inner dimension R of the rear receiving chamber 23*b*, and a transverse inner dimension S of the front receiving chamber 23*a* is larger than a transverse inner dimension $T_2$ of the opening 31 (Expressed this in terms of inequality, $T_1>R$, $S>T_2$). $T_1$ and $T_2$ are equal to each other, or different from each other ($T_1=T_2$, $T_1>T_2$ or $T_1<T_2$). In the example of FIG. 1, $T_1>T_2$.

This dimensional relation is determined based on such dimensional differences as to meet with all negative factors such as dimensional irregularities of the terminal receiving chambers 23 and the openings 31, a play between the connector housing 21 and the spacer 29, and dimensional errors due to thermal deformation. For example, the dimensional difference values are determined to be larger than the sum of the manufacturing tolerance, the amount of play (clearance) between the connector housing 21 and the spacer 29, and the thermal deformation amount.

The dimensions S, $T_1$, $T_2$ and R of the terminal receiving chamber 23 and the opening 31 shown in FIG. 1 are the dimensions in the transverse direction, and a similar dimensional relation is provided with respect to the longitudinal direction. More specifically, at the boundary between the opening 31 and the rear receiving chamber 23*b*, an open end of the opening 31 is larger over the entire periphery than an open end of the rear receiving chamber 23*b*. At the boundary between the front receiving chamber 23*a* and the opening 31, an open end of the front receiving chamber 23*a* is larger over the entire periphery than an open end of the opening 31.

Namely, any step against which the terminal 25 abuts during the insertion thereof is not formed at the boundary between the opening 31 and the rear receiving chamber 23*b* and at the boundary between the front receiving chamber 23*a* and the opening 31.

The dimensional relation between the terminal receiving chamber 23 and the opening 31 is determined as described above, and with this arrangement, the double-retaining connector of this embodiment is achieved.

In the double-retaining connector 35 of this construction, when the spacer 29 is disposed in the provisionally-retained condition, the edge of the open end of the opening 31 is always disposed outwardly of the open end of the rear receiving chamber 23*b*, and also the edge of the open end of the front receiving chamber 23*a* is always disposed outwardly of the open end of the opening 31. Therefore, any step against which the terminal abuts during the insertion thereof is not formed at the boundaries between the terminal receiving chamber 23 and the spacer 29. Therefore, there is eliminated the situation in which the terminal 25 abuts against a step, so that the inserting resistance is increased.

In the above double-retaining connector 35, the terminal 25 will not abut against any step, and therefore the insertion of the terminal 25 can be effected quite smoothly. As a result, the terminals can be inserted by an automation machine.

Another preferred embodiment of a double-retaining connector of the present invention will now be described.

Figure 2:
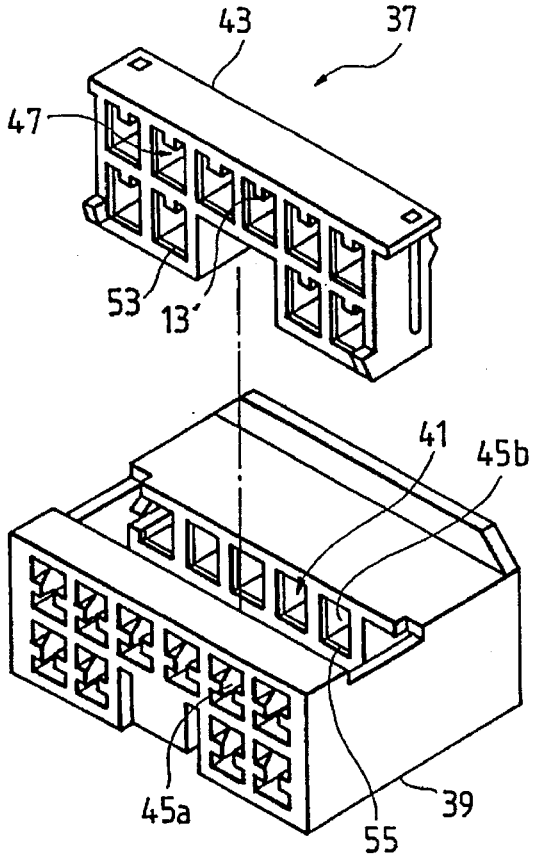
FIG. 2 is an exploded perspective view of another embodiment of a double-retaining connector of the invention.
Figure 4:
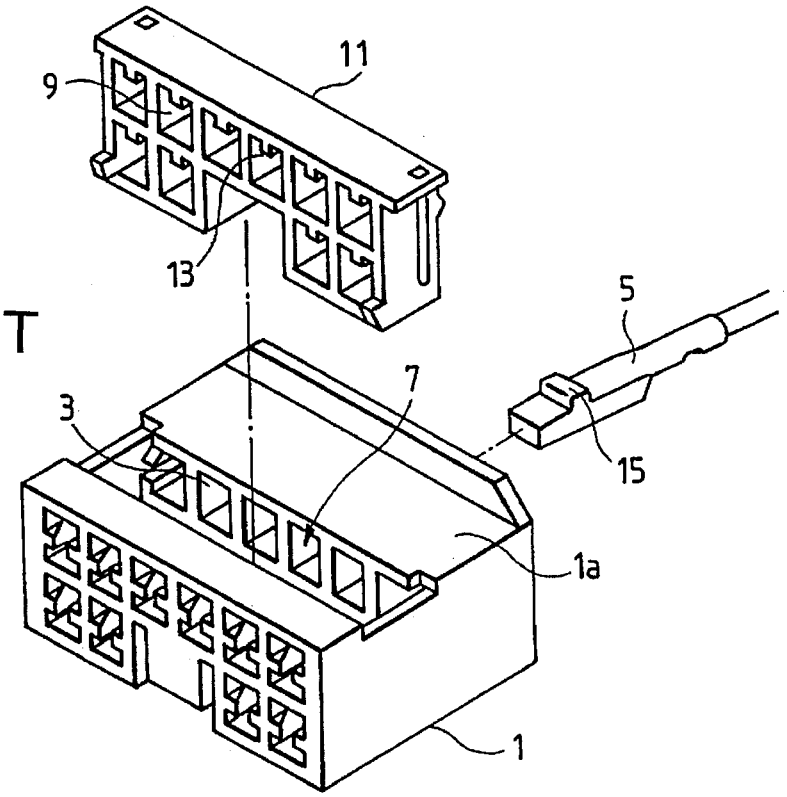
FIG. 4 PRIOR ART
FIG. 4 is an exploded perspective view of a conventional double-retaining connector provided with a spacer.
Figure 3:
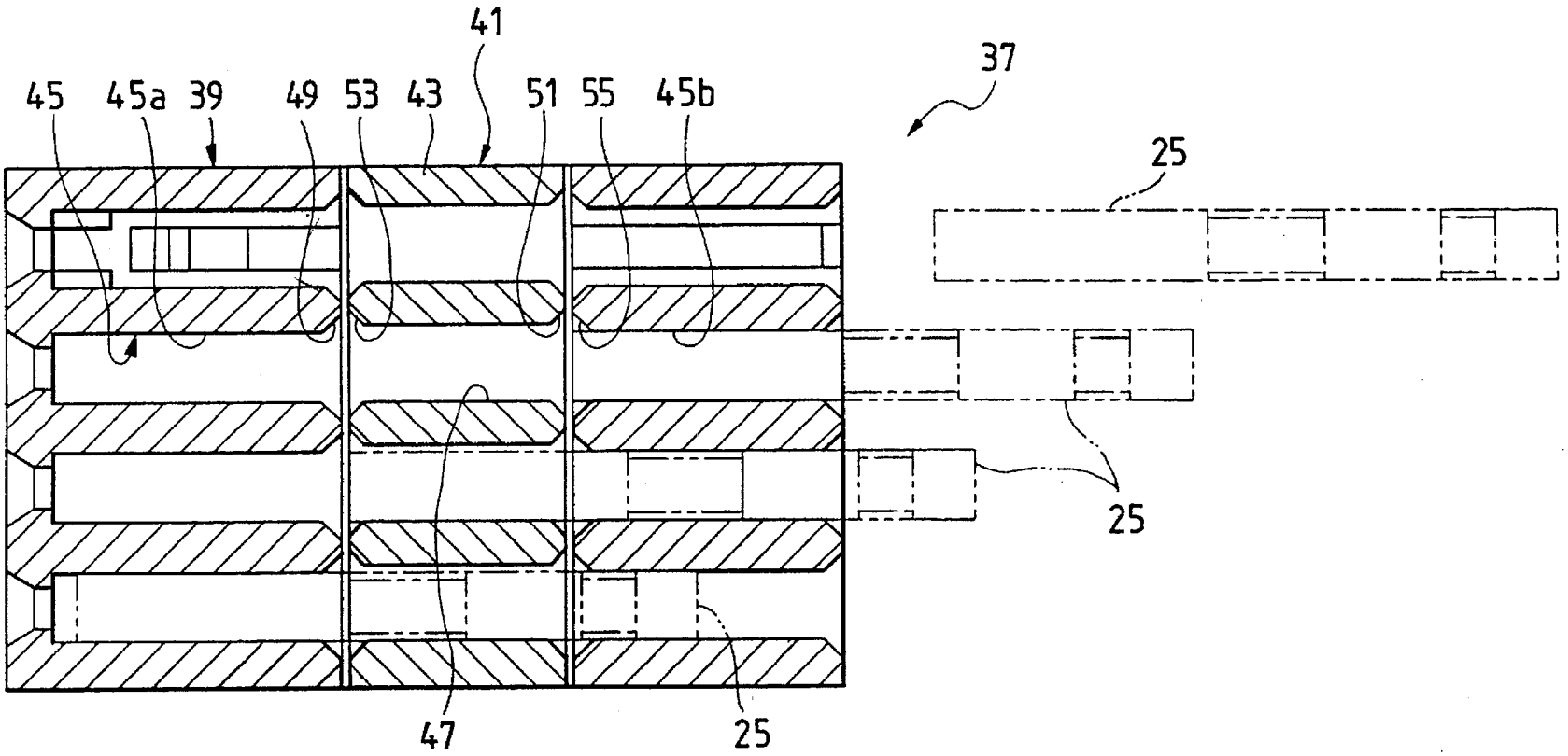
FIG. 3 is a transverse cross-sectional view of the double-retaining connector of FIG. 2.
Figure 5:
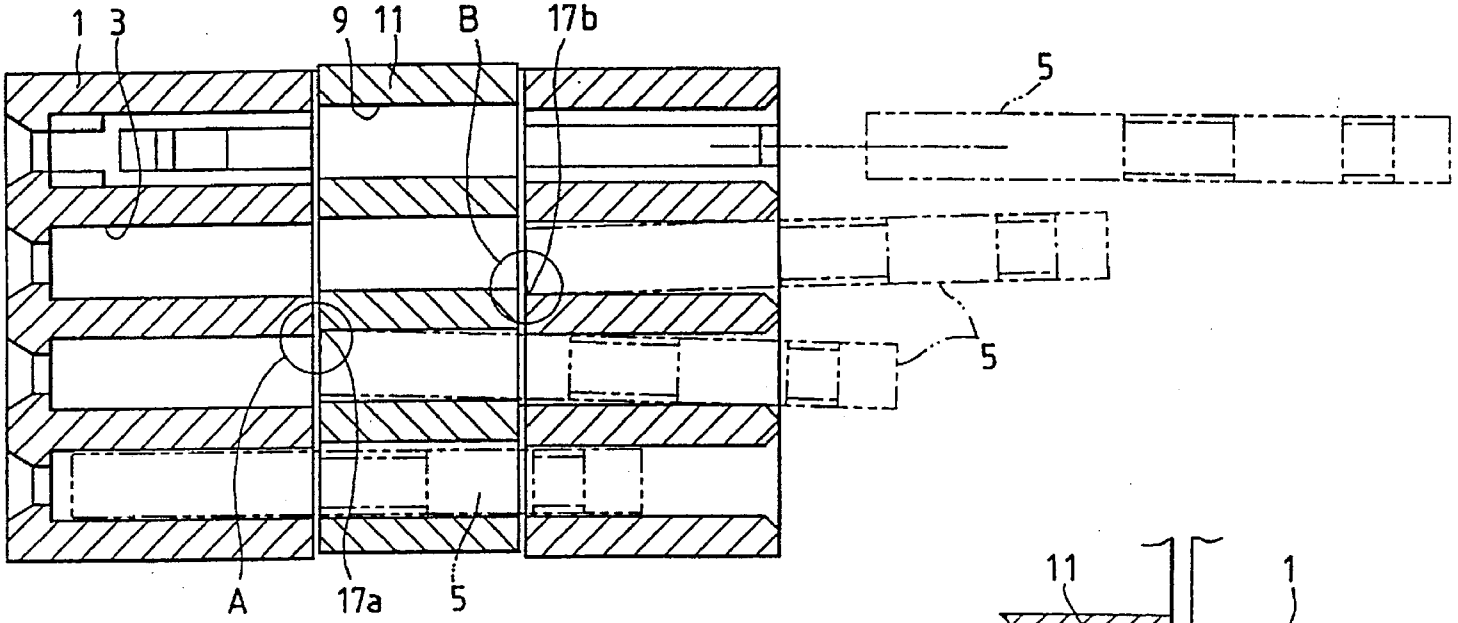
FIG. 5 PRIOR ART
FIG. 5 is a view explanatory of steps causing a problem during the insertion of a terminal.
Figure 6:
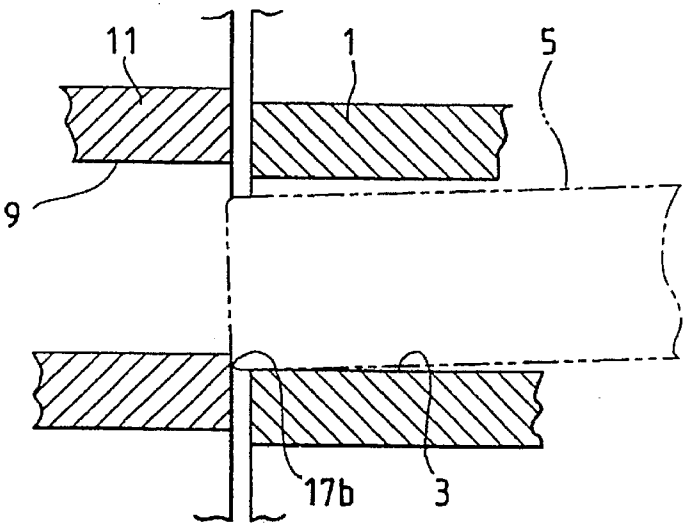
FIG. 6 PRIOR ART
FIG. 6 is an enlarged view of the step.
Figure 7:
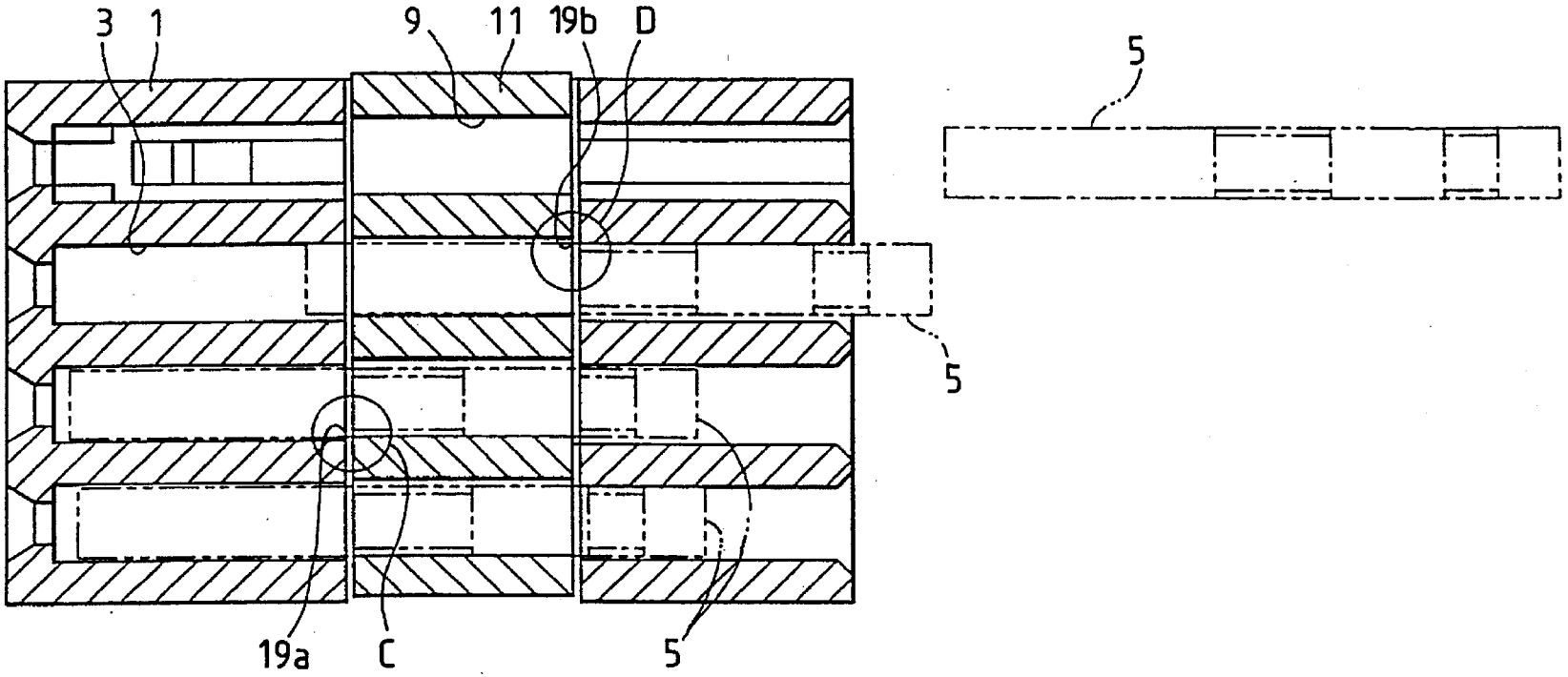
FIG. 7 PRIOR ART
FIG. 7 is a view explanatory of steps causing a problem during the withdrawal of the terminal.

FIG. 2 is an exploded perspective view of the double-retaining connector of this embodiment, and FIG. 3 is a horizontal cross-sectional view of the double-retaining connector of FIG. 2.

The double-retaining connector 37 of this embodiment includes as main parts or portions a connector housing 39, a cavity 41 and spacer 43 generally similar to those of the above-mentioned double-retaining connector 35. With respect to the dimensional relation between a terminal receiving chamber 45 and an opening 48, the above predetermined relation ($T_1$>R, S>$T_2$) may or may not be provided. In the example of FIG. 3 it is not provided.

In the double-retaining connector 37, edges at the boundary between the opening 47 and a rear receiving chamber 45*b*, as well as edges at the boundary between a front receiving chamber 45*a* and the opening 47, are chamfered to provide tapering surfaces. More specifically, as shown in FIG. 3, a tapering surface 49 is formed at the terminal insertion-side end of the front receiving chamber 45*a*, and a tapering surface 51 is formed at the terminal insertion-side end of the opening 47, and the tapering surfaces 49 and 51 are flat surfaces slanting in the inserting direction so that the terminal 25 will not be caught by these ends. A tapering surface 53 is formed at the terminal withdrawal-side end of the opening 47, and a tapering surface 55 is formed at the terminal withdrawal side-end of the rear receiving chamber 45*b* (see FIGS. 2 and 3), and the tapering surfaces 53 and 55 are flat surfaces slanting in the withdrawing direction so that the terminal 25 will not be caught by these ends. Each of the tapering surfaces 49, 51, 53 and 55 is formed over the entire edge of the corresponding open end.

In the double-retaining connector 37 of this construction, when the spacer 43 is disposed in a provisionally-retained-condition, the opening 47 and the rear receiving chamber 45*b* are made continuous with each other by the tapering surfaces 51 and 55 at the boundary therebetween, and also the front receiving chamber 45*a* and the opening 47 are made continuous with each other by the tapering surfaces 49 and 53 at the boundary therebetween. At that portion where each pair of tapering surfaces are continuous with each other, there is provided a peripheral groove of a V-shaped cross-section formed in the inner peripheral surface. In this condition, any projected step which catches the terminal 25 is not formed, or even if a step is formed, it will not serve as a portion for catching the terminal. Therefore, the terminal 25 will not be caught during the insertion and withdrawal thereof.

In the double-retaining connector 37, as in the above-mentioned double-retaining connector 35, the insertion of the terminal 25 can be carried out smoothly, and besides the withdrawal of the terminal 25 can be effected smoothly.

Although the above embodiments have been described with respect to the double-retaining connectors 35 and 37 having the male connector housing and the female terminal construction, the prevent invention can be applied to a double-retaining connector having a female connector housing and a male terminal construction.

In the above embodiment, although the tapering surfaces 49, 51, 53 and 55 are the flat, slanting surfaces, the tapering surfaces 49, 51, 53 and 55 may be curved, slanting surfaces. In this case, it is preferred that the curved surfaces be convex so as to effectively prevent the terminal from being caught.

In the double-retaining connector in which the open end of the opening is larger than the open end of the rear receiving chamber, and the open end of the front receiving chamber is larger than the open end of the opening, any step against which the terminal abuts during the insertion thereof is not formed at the boundary between the terminal receiving chamber and the spacer. Therefore, the terminal can be inserted smoothly, thereby enhancing the operation efficiency and eliminating an obstacle to the achievement of an automation production.

In the double-retaining connector in which the tapering surfaces are formed respectively at the terminal insertion-side ends of the front receiving chamber and the opening, and the tapering surfaces are formed respectively at the terminal withdrawal-side ends of the opening and the rear receiving chamber, any projected step for catching the terminal is not formed, or even if a step is formed, it will not serve to catch the terminal. Therefore, the terminal can be inserted and withdrawn smoothly.

If the tapering surfaces are convexly curved, the friction between the terminal and the tapering surface produced when they contact each other is reduced, so that the operation efficiency can be further enhanced.

What is claimed is:

1. A double-retaining connector comprising:

a connector housing having terminal receiving chambers and a cavity formed in the connector housing across the terminal receiving chambers, said cavity opened to an outer surface of the connector housing; and a spacer inserted into the cavity, said spacer having openings which are aligned respectively with the terminal receiving chambers for allowing terminals to pass through the openings, respectively, wherein each of the terminal receiving chambers are divided by the cavity into a front receiving chamber at a front side of said connector housing in a terminal inserting direction and a rear receiving chamber at a rear side of said connector housing in such a manner that the cavity is interposed between the front and rear receiving chambers, one end of each of the openings is larger than an open end of the rear receiving chamber at a boundary between the one end of each of the openings and the rear receiving chamber, and an open end of the front receiving chamber is larger than the opposite end of each of the openings at a boundary between the front receiving chamber and the opposite end of each of the openings.

2. A double-retaining connector as claimed in claim 1, wherein tapering surfaces are formed respectively at the one end of each of the openings and at terminal insertion-side open end of the front receiving chamber.

3. A double-retaining connector as claimed in claim 2, wherein the tapering surfaces are formed respectively at the opposite end of each of the openings and at the terminal withdrawal-side open end of the rear receiving chamber.

4. A double-retaining connector as claimed in claim 2, wherein the shape of the tapering surfaces are one of flat and convexity.

5. A double-retaining connector according to claim 1, wherein the spacer is inserted into the cavity in a two-stage manner of a provisionally-retained condition and a completely-retained condition.

6. The double-retaining connector of claim 1, wherein the inner dimension of the openings at the one end is equal to the inner dimension of the openings at the other end.

7. The double-retaining connector of claim 1, wherein the inner dimension of the openings at the one end is different from the inner dimension of the opening at the opposite end.

* * * * *